US005151635A

United States Patent [19]

Cappels

[11] Patent Number: 5,151,635

[45] Date of Patent: Sep. 29, 1992

[54] APPARATUS AND METHOD FOR REDUCING THE MAGNITUDE OF TIME VARYING ELECTRIC FIELDS IN CRT DISPLAYS

[75] Inventor: Richard D. Cappels, San Jose, Calif.

[73] Assignee: Apple Computer, Inc., Cupertino, Calif.

[21] Appl. No.: 717,946

[22] Filed: Jun. 20, 1991

[51] Int. Cl.[5] ..... G09G 1/04; H01J 29/06; H01J 1/52

[52] U.S. Cl. ..... 315/370; 315/8; 315/85

[58] Field of Search ..... 315/370, 8, 85; 361/4, 361/159, 233; 307/91, 90, 89

[56] References Cited

U.S. PATENT DOCUMENTS

| | | | |
|---|---|---|---|
| 3,963,975 | 6/1976 | Gauper, Jr. et al. | 307/91 |
| 4,677,344 | 6/1987 | Toshiyasu et al. | 315/85 |
| 4,767,969 | 8/1988 | Green | 315/85 |
| 4,853,588 | 8/1989 | Ohtsu et al. | 315/85 |
| 5,101,139 | 3/1992 | Lechter | 315/85 |

OTHER PUBLICATIONS

IBM Tech. Disc. Bulletin, "Cancellation of Leaked Magnetic Flux" vol. 30, No. 12, May 1988 pp. 9-10.

*Primary Examiner*—Gregory C. Issing
*Attorney, Agent, or Firm*—Stuart J. Madsen

[57] ABSTRACT

An electric field cancellation system and method for reducing electric fields are presented, especially suited for use in reducing the magnitude of electric field emissions from a CRT display. Signals from the electric field sources of the display are used to generate counter signals of equal magnitude and opposite polarity to the source signals. These counter signals are coupled to a plurality of transmitters which effectively establish a counter electric field, or fields, of opposite polarity to the source fields. The net effect is substantial reduction in the electric field emissions from the display, and a resultant electric field of substantially reduced magnitude encountered by a display operator.

20 Claims, 4 Drawing Sheets

APPARATUS AND METHOD FOR REDUCING THE MAGNITUDE OF TIME VARYING ELECTRIC FIELDS IN CRT DISPLAYS

BACKGROUND OF THE INVENTION

1. Field of the Invention

The present invention relates generally to apparatus and methods for reducing the magnitude of electric field emissions, and more specifically to an AC electric field cancellation system and method for reducing the magnitude of time varying electric field emissions from a CRT display.

2. Brief History of the Art

Cathode Ray Tube (CRT) displays are used in conjunction with a wide variety of information and entertainment systems, and are most commonly associated with ordinary television sets and computer monitors. These displays normally include complex electronic circuitry which generates a substantial number and variety of complex alternating electromagnetic fields. A significant portion of these electric fields emanate towards and through the CRT screen, rear and sides of the display, eventually reaching the display operator and those in the proximity of the display.

In conventional color displays, the shadow mask, aluminum coating on the back of the phosphor, and the CRT's internal magnetic shield all play an important role in the electric field profile of the monitor, often serving as radiators of the internal electric fields. For example, in displays with an integrated high voltage horizontal deflection circuit, the anode voltage may be modulated by side pin cushion correction. The resulting parabolic voltage wave form is integrated by the flyback transformer driving impedance and the anode capacitance, typically resulting in an approximately tens of volts, peak to peak, of S shaped or sometimes parabolic wave form. Peak to peak video current from the cathode generates a voltage drop across the anode impedance, which is determined by the aquadag capacitance and whatever bleeder resister may be present. The result is low passed video on the anode which may be super-imposed on the S or parabolic wave form, if present, as described above. When the worst case image is presented (one half screen white and one half screen black), the anode voltage can fluctuate up to several hundred volts, peak to peak. Thus stimulated, the shadow mask, the aluminum coating on the back of the phosphor, and the CRT's internal magnetic shields radiate AC electric fields.

Another source of electric fields, particularly in the very low frequency range, is the flyback pulse from the horizontal deflection circuit. This pulse ranges from several hundred volts for some monochrome displays to over a kilovolt for color displays. Additionally, at extremely low frequencies, the vertical deflection circuit, power mains wiring, and if present, the degaussing coil often contribute to the voltage fields.

During the past several years major concerns have been raised by various groups regarding potential health hazards inherent in devices which generate electric fields. Although there are presently no U.S. government regulatory standards defining harmful vs. nonharmful levels of electric field exposure, several international communities have discussed potential guidelines. Increased public awareness of these potential hazards has surfaced, and has led to an increasing number of products designed to limit the intensity of electric field emissions.

To address these concerns, display manufacturers have integrated a variety of countermeasures into the display design. Conventional methods of reducing the magnitude of the electric field from a CRT display mainly consist of various types of shielding. For example, an existing counter measure for reducing the frontally directed AC electric field includes placing a conductive screen or thin metal film over the CRT face. The screen or film must then be electrically connected to chassis ground. Although this and other counter measures help in reducing overall field emissions, there are several serious inherent problems which limit their effectiveness. These problems include degradation of front of screen CRT performance, mechanical form and fit problems, increased internal temperature due to restricted air flow, increased unit weight, increased power dissipation and geometric distortion of the display image, and high associated design and production costs. Thus, the existing solutions for reducing the AC electric field emissions from a CRT display are inadequate.

SUMMARY OF THE INVENTION

Time varying electric fields can be canceled by the introduction of counter electric fields of equal magnitude but opposite polarity. The present invention comprises a novel electric field cancellation system and method for reducing the magnitude of alternating electric field emissions from a CRT display which utilizes this principle of operation. Generally, a voltage wave form of equal magnitude but opposite polarity to that of the undesired electric field is developed and applied to one or more transmitters disposed to provide a cancellation field throughout the area of interest.

A portion of the voltage wave form, required to cancel the electric fields produced by the horizontal deflection circuit of the display, is generated using a signal directly from a winding on the horizontal flyback transformer. This signal is then coupled to one or more transmitters, which are positioned to establish a counterfield of equal magnitude and opposite polarity to that of the electric field produced by the horizontal deflection circuit.

A separate portion of the voltage wave form is developed using a displacement current electric field sensor coupled to the outer surface of the CRT. This sensor is normally operative to sense the ambient electric field established by a multitude of the display's electric components. The signal from this sensor is passed through an inverter, then amplified, and subsequently coupled to one or more sub-transmitters. The sub-transmitters are positioned to established a counterfield of equal magnitude and opposite polarity to that of the fields sensed by the displacement sensor.

An additional portion of the voltage wave form can be developed using a displacement current sensor coupled to the degaussing coil, if the display contains one. The signal from this sensor is passed through an inverter, then amplified, and subsequently coupled to one or more sub-transmitters. These sub-transmitters are positioned to establish a counterfield of equal magnitude and opposite polarity to the field produced by the degaussing coil.

IN THE DRAWINGS

FIG. 1 a block diagram illustrating the interrelationship between the field cancellation subsystems and the source fields in accordance with the present invention.

FIG. 2*a* is a block diagram illustrating the Horizontal Deflection Circuit Field Cancellation Subsystem in detail.

FIG. 2*b* is a block diagram illustrating an alternative embodiment of the Subsystem shown in FIG. 2*a*.

DETAILED DESCRIPTION OF THE PREFERRED EMBODIMENT

An electric field cancellation system and method for canceling an electric field are disclosed having particular application for use in conjunction with a computer monitor or similar CRT base device. In the following description, for purposes of explanation, specific numbers, materials and configurations are set forth in order to provide a thorough understanding of the present invention. However, it will be apparent to one skilled in the art that the present invention may be practiced without reference to the specific details. In other instances, well known systems are shown in diagrammatical or block diagram form in order not to obscure the present invention unnecessarily.

As discussed above, CRT displays include a substantial number of electrical components which can act as sources of unwanted electric fields. For example, complex AC electric fields are generated at various frequencies by the deflection yoke, flyback transformer, vertical deflection circuit, degaussing coil, etc. Generally, a field cancellation system and method in accordance with the present invention utilize a signal from one or more of these field sources to develop a countersignal of opposite polarity to the polarity of the source signal. The countersignal is then used to establish a counterfield of opposite polarity to the electric field produced by the source. This results in a substantially reduced resultant field emitted from the display and exposed to the display operator.

A signal from any of the individual electric field sources, or signals from multiple electric field sources, can be used to generate a countersignal or multiple counter-signals, with the necessary characteristics for establishing a counter electric field. Thus, for example, if it is desired to solely cancel the electric field produced by a single source, than a signal from this distinct source is used to generate the distinct countersignal of opposite polarity of the source signal. This countersignal is then used to develop the counterfield of opposite polarity to the source electric field. Alternatively, any combination of field sources could be used to establish a single resultant counterfield, or a series of separate counter-fields dedicated to neutralizing fields from separate sources.

Figure 1:
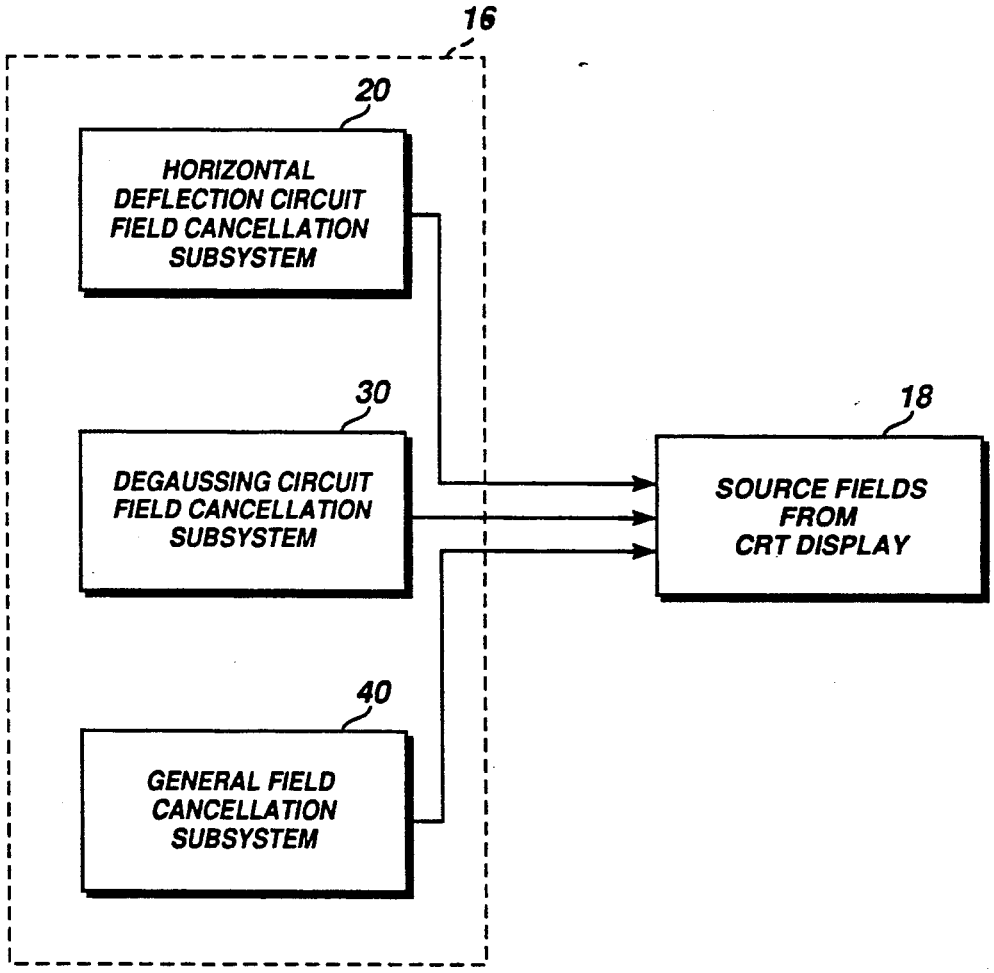

Referring briefly to FIG. 1, shown is a block diagram illustrating an electric field cancellation system 16 in accordance with the preferred embodiment of the present invention. In this embodiment, cancellation system 16 comprises three separate electric field cancellation subsystems which effectively establish counter electric fields directed at eliminating source electric fields 18 produced by various electrical components of the display: a Horizontal Deflection Circuit Field Cancellation Subsystem 20 establishes a counter electric field dedicated to neutralizing the electric field produced by the horizontal deflection circuit of the display; a Degaussing Circuit Field Cancellation Subsystem 30 establishes a counter electric field dedicated to neutralizing the electric field produced by the degaussing coil of the display; and, a General Field Cancellation Subsystem 40 establishes a counter electric field dedicated to neutralizing the electric field produced by various other electrical components of the CRT display. Of course, additional subsystems could be employed to neutralize the electric fields produced by additional field sources. Likewise, any of the above Subsystems could be eliminated if the respective field sources were eliminated from the display.

Figure 2A:
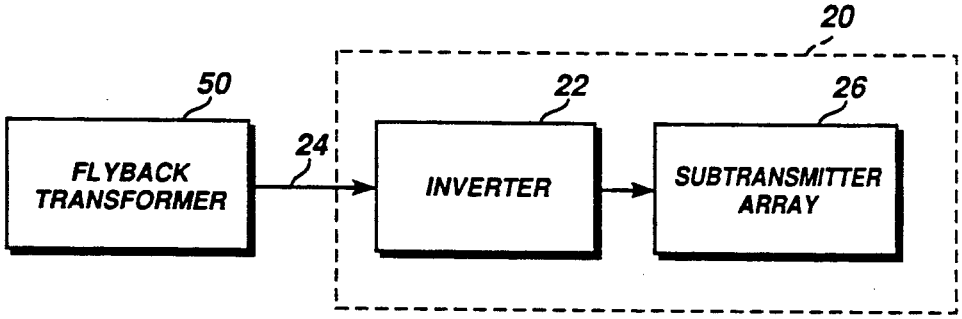

Referring now to FIG. 2*a*, shown is a block diagram of Horizontal Deflection Circuit Field Cancellation Subsystem 20, illustrating its interrelationship with a flyback transformer 50 of the CRT display. In the embodiment illustrated in FIG. 2*a*, a source signal from a winding on flyback transformer 50 is coupled to the input of an inverter 22 via a source conductor 24. Source conductor 24 can be an actual winding on flyback transformer 50, or, alternatively, a conductive wire coupled to the winding. Inverter 22 receives the source signal from transformer 50 and provides a countersignal of opposite polarity at its output. The output signal from inventer 22 is then coupled to the input of a sub-transmitter array 26 which effectively establishes a counterfield of opposite polarity to the electric field produced by flyback transformer 50. Inverter 22 could include an adjustable gain amplifier, if necessary, to equalize the magnitude of the source field and counterfield. Additionally, although described as a "sub-transmitter array", it is contemplated that any arrangement of sub-transmitters, or even a single sub-transmitter, could be used to establish the counter electric field.

Figure 2B:
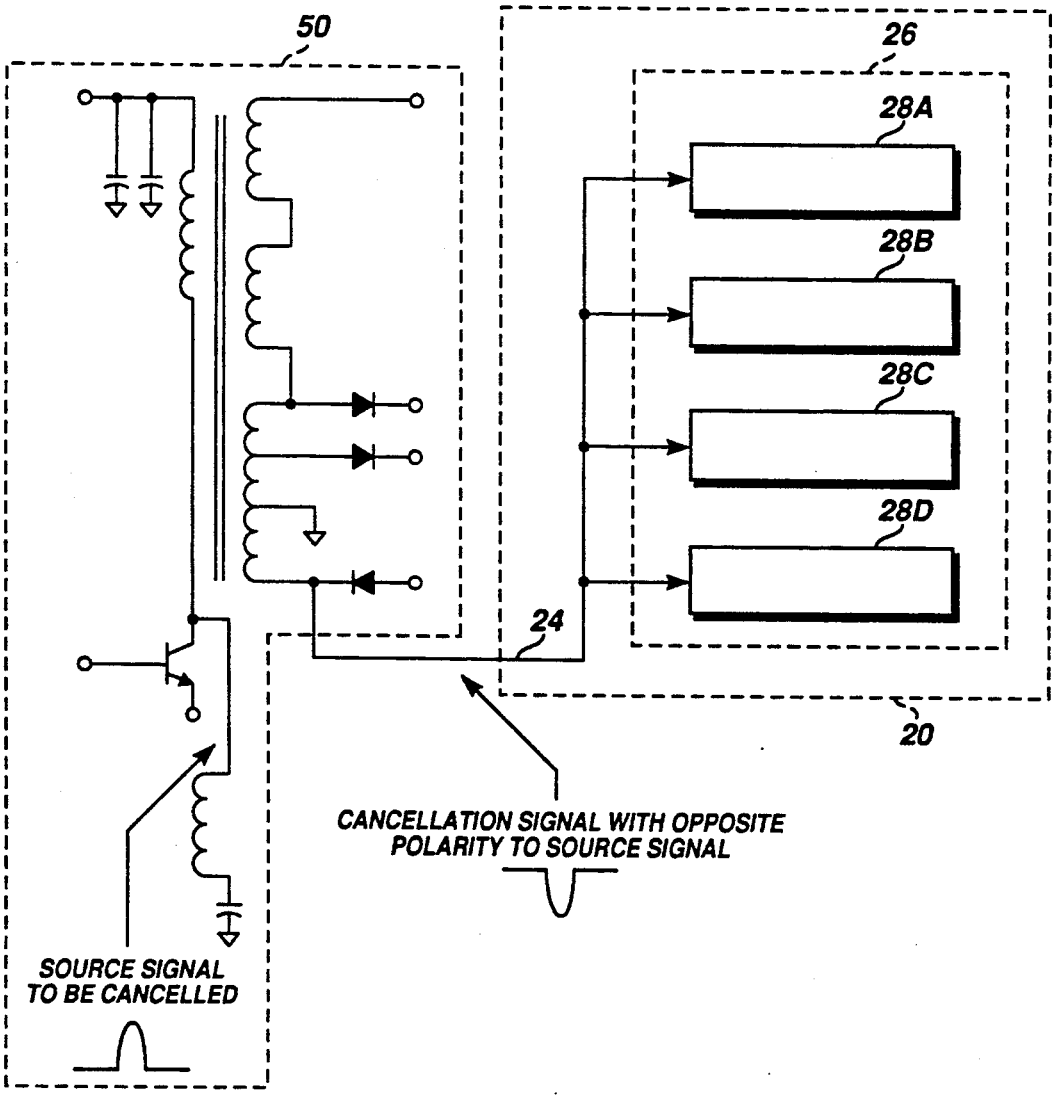

Referring now to FIG. 2*b*, shown is a schematic diagram illust an alternative embodiment of Horizontal Deflection Circuit Field Cancellation Subsystem 20. In this embodiment, the need for inverter 22, shown in FIG. 2*a*, has been eliminated by using a countersignal taken directly from flyback transformer 50. This is possible because a substantial number of flyback transformers used in CRT display technology include their own countersignal source, or can be easily modified to include a countersignal source, which provides a signal of opposite polarity to the source signal. This countersignal can be tapped directly via conductor 24, and coupled directly to sub-transmitter array 26.

In the embodiment of FIG. 2*b*, the countersigal is taken directly from a winding on flyback transformer 50. As described above, this signal does not need to be inverted because it is already oppositely polarized with respect to the source signal which produces the flyback transformer source field. The countersignal is coupled via conductor 24 to a plurality of sub-transmitters 28*a*–28*d*. In the preferred embodiment, sub-transmitters 28*a*–28*d* each comprise a substantially rectangular strip of conductive material, such as copper. It is normally necessary to cancel the electric field generated by flyback transformer 50 on all four sides of the CRT display (the top and bottom are not considered). Thus, sub-transmitters 28*a*–28*d* are positioned about the display in a manner which maximizes electric field cancellation. Of course, the specific dimensions and operational positions of the sub-transmitters are determined by the specific chassis design and electric field characteristics of a particular display. In the preferred embodiment, cancellation is normally achieved by placing a sub-transmitter on the front, back, and each side of the display. For example, sub-transmitter 28*a* is positioned at the front of the display, near the display screen, 28*b* at the rear of the display, 28*c* on a first side of the display, and 28*d* on a second side of the display, opposite the first side.

A significant advantage of the embodiment as detailed in FIG. 2*b* is the simplicity of its operation and the ease of the implementation. Dramatic electric field cancellation results are achieved by coupling the countersignal, taken in its original form from transformer 50, directly to the sub-transmitter array, as described above. Thus, field cancellation is achieved using a minimal number of components, resulting in a minimal expense and resource expenditure. Of course, the cancellation signal could be amplified as necessary to adjust the magnitude of the counterfield in relation to the source field such that appropriate cancellation occurs. However, in normal operation, amplification has proved unnecessary in establishing an electric field of equal magnitude to that of the flyback transformer source field.

Figure 3:
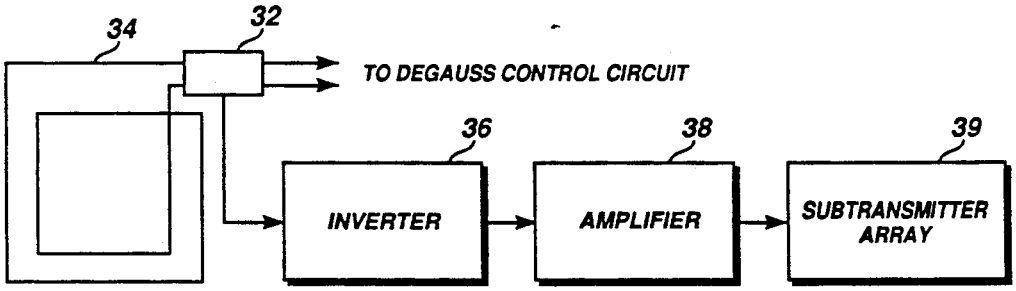
FIG. 3 is a block diagram illustrating the Degaussing Circuit Field Cancellation Subsystem in detail.

Referring now to FIG. 3, shown is a block diagram illustrating Degaussing Circuit Field Cancellation Subsystem 30 in detail. A degaussing coil signal sensor 32 is coupled to the leads of a degaussing coil 34 of the CRT display. Sensor 32 picks up a source signal from the coil and couples it to the input of an inverter 36 which provides a countersignal of opposite polarity to the input signal at its output. The output signal from inverter 36 is then coupled to the input of an amplifier 38 which amplifies the input signal to the level required to produce a counterfield equal in magnitude to the magnitude of the source field produced by degaussing coil 34. Adjustment of the gain level of amplifier 38 in normally made during display production. The output signal from amplifier 38 is then coupled to the input of a sub-transmitter 39 which effectively establishes the counter electric field. As will be described in further detail below, it should be noted that the output signal from inverter 36 can be mixed with the countersignal from one or more of the other cancellation subsystems, and coupled to a common sub-transmitter.

In the preferred embodiment, coil sensor 32 comprises a metallic pickup, such as a copper strip, capacitively coupled to the leads of the degaussing coil. Sub-transmitter 39 comprises a substantially rectangular strip of conductive material, such as copper, and is disposed in the display in a manner which facilitates effective cancellation of the degaussing coil source field. Normally sub-transmitter 39 is positioned at the front of the display, for example, on the display bezel.

Figure 4:
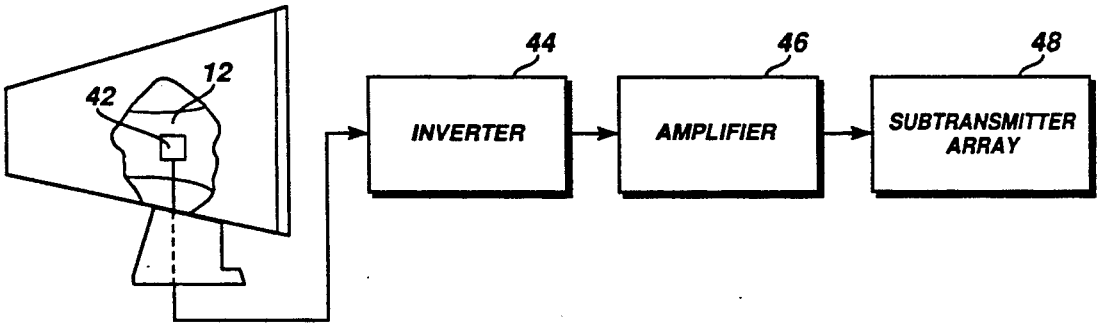
FIG. 4 is a combination of a partially broken elevational view illustrating the interrelationship between the current sensor and CRT, and a block diagram illustrating the General Field Cancellation Subsystem in detail.

Referring now to FIG. 4, shown is a block diagram illustrating General Field Cancellation Subsystem 40 in detail. Subsystem 40 comprises a displacement current electric sensor 42 which is coupled in a predetermined position directly to the outer surface of the CRT. In normal operation, sensor 42 effectively picks up the resultant electrical signal, produced by a combination of electric field sources, and couples it to the input of an inverter 44. Inverter 44 provides a countersignal of opposite polarity to the input signal at its output. The output signal from inverter 44 is then coupled to the input of an amplifier 46 which amplifies the input signal to the level required to produce a counterfield equal in magnitude to the magnitude of the resultant field sensed by sensor 42. The output signal from amplifier 46 is coupled to the input of a sub-transmitter 48 which effectively establishes the counter electric field. Normally, the resultant field sensed by sensor 42 is a combination of lower frequency electric fields produced by several separate electric field sources, such as, for example, the vertical deflection circuit and power mains wiring as discussed in the summary.

In the preferred embodiment, sensor 42 comprises a metallic pickup, such as a copper strip, capacitively coupled to the outer surface of the CRT near the anode connection of flyback transformer 50. Sub-transmitter 48 normally comprises a substantially rectangular strip of conductive material, such as copper, and is positioned at the front of the CRT (i.e., on the CRT bezel). As suggested with reference to FIG. 3, it is contemplated that the output signal from inverter 44 could be mixed with the countersignal from one or more of the other Cancellation Subsystems and coupled to a single amplifier and common sub-transmitter, or a transmitter array. Likewise, it is contemplated that sub-transmitter 48, as well as the other sub-transmitters described in the specification, could be placed at other various positions within the CRT display. The important feature to be preserved is the canceling effect of the counter electric field established by the sub-transmitter in relation to the electric field sources of the CRT display.

Figure 5:
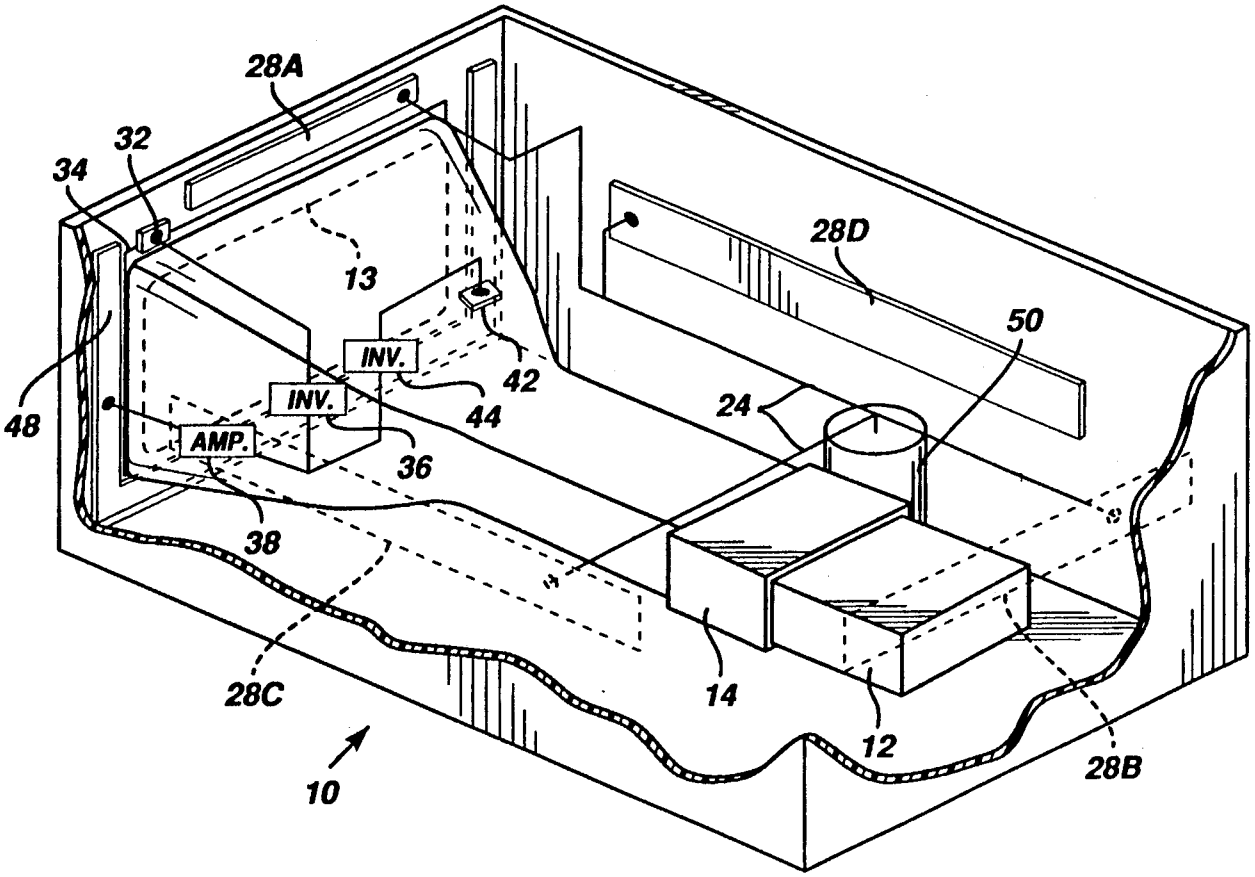
FIG. 5 is a partially broken perspective view of an electric field cancellation system in accordance with the present invention illustrating its interrelationship with a CRT display.

Referring now to FIG. 5 shown is a partially broken perspective view of an electric field cancellation system in accordance with the preferred embodiment of the present invention, illustrating it's interrelationship with a CRT display 10. CRT display 10 partially comprises a cathode ray tube (CRT) 12 having a screen 13 disposed towards the front of the display. A deflection yoke 14 is disposed about a portion of CRT 12 and is associated with flyback transformer 50. Although a number of other electrical components are necessary to provide a functional display, these various components will not be described in detail as to not obscure the explanation of the present invention.

As is illustrated in FIG. 5, a winding on flyback transformer 50 is coupled to sub-transmitters 28*a*–28*d* (28*b* and 28*c* shown in phantom) of sub-transmitter array 26 by source conductor 24. This combination of elements substantially comprises Horizontal Deflection Field Cancellation Subsystem 20. As described in detail above, array 26 is positioned within the display in a manner effective to establish a counter electric field of equal magnitude and opposite polarity to the electric field produced by flyback transformer 50. In the preferred embodiment, sub-transmitter 28*a* is disposed at the front of the display, juxtaposed to screen 13. Sub-transmitter 28*b* is disposed at the rear of the display, facing sub-transmitter 28*a*. Sub-transmitter 28*c* is disposed on a first side of the display, and sub-transmitter 28*d* is disposed on a second side of the display, facing sub-transmitter 28*c*. As will be obvious to those skilled in the art, a variety of sub-transmitter configurations could be employed, using the same or a different number of sub-transmitters, to achieve substantially the same electric field cancellation effect as that provided by array 26 as configured in FIG. 5. Additionally, a single contiguous sub-transmitter could be employed and disposed within the display to establish a substantially equivalent counter electric field to the counterfield established by array 26.

Displacement current electric field sensor 42 is shown in its normal operational position, coupled to the outer surface of CRT 12. The output from sensor 42 is coupled to the input of inverter 44, the output of which is coupled to the input of amplifier 38. The output signal from amplifier 38 is coupled to sub-transmitter 48, disposed on the front bezel of display 10. This combination substantially comprises General Field Cancellation Subsystem 40.

Degaussing coil sensor 32 is coupled to degaussing coil 34, normally disposed about the perimeter of screen 13, and provides an input source electrical signal to inverter 36. In the preferred embodiment, the output signal from inverter 36 is mixed with the output signal from inverter 44 (associated with General Field Cancellation Subsystem 40). The resultant signal produced by this combination of countersignals is coupled to the input of amplifier 38, the output of which is coupled to sub-transmitter 48. Although described above as including separate sub-transmitters 39 and 48, and separate amplifiers 38 and 46 (which is, of course, a plausible configuration), in the embodiment depicted in FIG. 5, Subsystem 30 and Subsystem 40 share a common amplifier, amplifier 38, and a common sub-transmitter, sub-transmitter 48. The decision to combine the counter-signals from inverters 36 and 44, and to couple this resultant signal combination to a single sub-transmitter is a matter of design convenience and economy and should not be viewed as a material limitation of the cancellation system. Sub-transmitter 48 effectively establishes a counter electric field of opposite polarity to the electric field produced by degaussing coil 44 and the resultant electric field sensed by displacement current electric field sensor 42.

Although the present invention has been described with reference to the various figures and with emphasis on an integrated and complete electric field cancellation system, it should be understood that the figures are for illustration only and should not be taken as limitations on the invention. It is contemplated that many changes and modifications may be made by one of ordinary skill in the art to the present invention, without departing from the true spirit and scope of the invention as described above. For example, a variety of alternative sub-transmitter configurations can be envisioned which would achieve a substantially equivalent electric field cancellation effect as the configuration disclosed in FIG. 5. In certain monitors, it might not be necessary to include a sub-transmitter at the rear, or alternatively, it might not be necessary to include sub-transmitters on the sides. The appropriate sub-transmitter configuration depends on the specific electric field characteristics of the monitor.

Additionally, as mentioned above, it is contemplated that a single sub-transmitter could be utilized for electric field cancellation, if appropriately shaped. It is also possible, of course, to employ a single subsystem for canceling only the electric field produced by a single field source. Thus, for example, one concerned only with neutralizing the electric field produced by degaussing coil 34 would use only Degaussing Circuit Field Cancellation Subsystem 30 to establish the requisite counterfield. In this example, Horizontal Deflection Circuit Field Cancellation Subsystem 20 and General Field Cancellation Subsystem 40 would not be used. Also of importance, the various wave forms necessary to establish the counter electric fields can be synthesized by means other than those as described in association with the various Subsystems above.

What is claimed:

1. An electric field cancellation system for use in a CRT display comprising:

means for determining the magnitude and polarity of a source electric field in the display and developing a counter electrical signal of opposite polarity to the polarity of said source field; and, counter electric field transmitting means, coupled to said determining and developing means, for using said countersignal to establish a counter electric field of opposite polarity to said source field in a manner such that said counter electric field couples with said source electric field to produce a resultant electric field of substantially reduced magnitude in comparison to the magnitude of said source field, thereby reducing electric field emission from the display.

2. An electric field cancellation system as described in claim 1 wherein said determining and developing means uses a first source electrical signal from a winding on a flyback transformer of the display to develop a first counter electrical signal oppositely polarized with respect to said first source signal, said counterfield being operative thereby to substantially cancel a first electric field produced by the transformer.

3. An electric field cancellation system as described in claim 1 wherein said determining and developing means includes a displacement current electric field sensor, coupled in a predetermined position to the outer surface of the CRT, for developing a source electrical signal representative of said source field, and further includes an inverter, coupled between said field sensor and said transmitting means, for producing said counter electrical signal, said counterfield being operative thereby to substantially cancel said source field.

4. An electric field cancellation system as described in claim 3 further comprising:

amplification means, coupled between said inverter and said transmitting means, for amplifying said counter electrical signal such that the magnitude of said counter electric field is substantially equal to the magnitude of said source field.

5. An electric field cancellation system as described in claim 1 wherein said determining and developing means includes a degaussing coil electric field sensor, coupled to a degaussing coil of the display, for developing a source electrical signal representative of an electric field produce by the degaussing coil, and further includes an inverter, coupled between said field sensor and said transmitting means, for producing said counter electrical signal, said counterfield being operative thereby to substantially cancel the degaussing coil electric field.

6. An electric field cancellation system as described in claim 5 further comprising:

amplification means, coupled between inverter and said transmitting means, for amplifying said counter electrical signal such that the magnitude of said counter electric field is substantially equal to the magnitude of said source field.

7. An electric field cancellation system as described in claim 1 wherein said transmitting means includes a plurality of conductive strips disposed at predetermined positions in the display.

8. An electric field cancellation system as described in claim 7 wherein said conductive strips are positioned at the front, back and sides of the display.

9. An electric field cancellation system as described in claim 2 wherein said determining and developing means includes a general displacement current electric field sensor, coupled in a predetermined position to the outer surface of the CRT, for developing a second source electrical signal representative of a second electric field sensed by said general sensor, and further includes a first inverter, coupled between said general sensor and said transmitting means, for producing a second countersignal of opposite polarity to said second source signal, said counter electric field being operative thereby to substantially cancel said second electric field.

10. An electric field cancellation system as described in claim 9 wherein said determining and developing means includes a degaussing coil electric field sensor, coupled to a degaussing coil of the display, for developing a third source electrical signal representative of a third electric field produced by the degaussing coil, and further includes a second inverter, coupled between said degaussing coil sensor and said transmitting means, for producing a third countersignal of opposite polarity to the polarity of said third source electrical signal, said counter electric field being operative thereby to substantially cancel said third electric field.

11. An electric field cancellation system as described in claim 2 wherein said transmitting means includes a plurality of conductive strips disposed at predetermined positions within the display.

12. An electric field cancellation system as described in claim 9 wherein said transmitting means includes a plurality of conductive strips disposed at predetermined positions within the display.

13. An electric field cancellation system as described in claim 10 wherein said transmitting means includes a plurality of conductive strips disposed at predetermined positions within the display.

14. An electric field cancellation system as described in claim 13 wherein said conductive strips are positioned at the front, back and sides of the display.

15. A method for reducing the magnitude of a source electric field generated by an electric field source, or plurality of field sources, in a CRT display and emitted from the display, comprising the steps of:

determining the magnitude and polarity of the source electric field;

developing a counter electrical signal of equal magnitude and opposite polarity to the magnitude and polarity of the source field;

establishing a counter electric field of equal magnitude and opposite polarity to the magnitude and polarity of the source field using said counter electrical signal; and, coupling said counterfield with the source field in a manner such that the magnitude of the source field is substantially diminished by said counterfield, thereby reducing the magnitude of electric field emitted from the display.

16. A method as described in claim 15 wherein said determining step includes utilizing a first source signal from a winding on a flyback transformer of the display to determine at least a first portion of said source electric field, and said developing step includes using said first source signal to develop a first countersignal of opposite polarity to the polarity of said first source signal.

17. A method as described in claim 15 wherein said determining step includes positioning a displacement current electric field sensor at a predetermined position in said display for determining at least a first portion of said source electric field and providing a source signal representative of the magnitude and polarity of said first portion, and further wherein said developing step includes inverting said source signal to produce said countersignal.

18. A method as described in claim 17 wherein said establishing step includes coupling said counter electrical signal to a plurality of conductive strips disposed at predetermined positions in the display.

19. A method as described in claim 16 wherein said determining step includes positioning a displacement current electric field sensor at a predetermined position in said display for determining at least a second portion of said source electric field and providing a source signal representative of the magnitude and polarity of said second portion, and further wherein said developing step includes inverting said source signal to produce a countersignal of opposite polarity to the polarity of said source signal.

20. A method as described in claim 19 wherein said establishing step includes coupling said counter electrical signal to a plurality of conductive strips disposed at predetermined positions in the display.

* * * * *